US005253153A

United States Patent [19]

Mathews et al.

[11] Patent Number: 5,253,153

[45] Date of Patent: Oct. 12, 1993

[54] VEHICLE HEADLAMP COMPRISING A METAL-HALIDE DISCHARGE LAMP INCLUDING AN INNER ENVELOPE AND A SURROUNDING SHROUD

[75] Inventors: Paul G. Mathews; Gary R. Allen, both of Chesterland, Ohio

[73] Assignee: General Electric Company, Schenectady, N.Y.

[21] Appl. No.: 945,543

[22] Filed: Sep. 16, 1992

[51] Int. Cl.[5] ..... F21V 7/09

[52] U.S. Cl. ..... 362/310; 362/61; 362/263; 313/25; 313/113

[58] Field of Search ..... 362/61, 263, 267, 296, 362/310; 313/25, 113

[56] References Cited

U.S. PATENT DOCUMENTS

| | | | |
|---|---|---|---|
| 2,272,467 | 2/1942 | Kern et al. | 313/25 |
| 4,800,467 | 1/1989 | Lindae et al. | 362/310 |
| 4,864,180 | 9/1989 | English et al. | 313/25 |
| 4,935,668 | 6/1990 | Hansler et al. | 315/82 |
| 4,949,003 | 8/1990 | Cox et al. | 313/25 |
| 5,106,150 | 5/1991 | Gordin et al. | 362/263 |

FOREIGN PATENT DOCUMENTS 0465083 1/1992 European Pat. Off. .

*Primary Examiner*—Albert J. Makay
*Assistant Examiner*—Alan B. Cariaso
*Attorney, Agent, or Firm*—Edward M. Corcoran; Stanley C. Corwin

[57] ABSTRACT

This headlamp comprises a reflector and a discharge lamp comprising an inner envelope having a longitudinal axis coinciding with the optical axis of the reflector. The inner envelope includes a bulbous portion, a front leg extending along the optical axis from the bulbous portion toward the front of the headlamp, and a back leg extending along the optical axis from the bulbous portion toward the reflector. The discharge lamp further comprises a tubular shroud comprising a first hollow portion surrounding the front leg of the inner envelope, a second hollow portion surrounding the back leg of the inner envelope, and a bulbous portion between the two hollow portions. The front leg is provided with a large-diameter integral enlargement (referred to herein as a "large-diameter maria"), and the shroud is joined to the front leg by a maria seal located at the outer periphery of this maria. The shroud is joined to the back leg of the inner envelope by a low-profile seal of substantially smaller diameter than the large-diameter maria seal located much closer to the longitudinal axis of the inner envelope than is the large-diameter maria seal.

The bulbous portion of the shroud has (i) a back zone facing the reflector of generally ellipsoidal configuration and (ii) a central axis upwardly offset by a small distance from the longitudinal axis of the inner envelope. This offset has been found to substantially increase the ratio of the seeing light to the glare light in the headlamp beam.

34 Claims, 7 Drawing Sheets

VEHICLE HEADLAMP COMPRISING A METAL-HALIDE DISCHARGE LAMP INCLUDING AN INNER ENVELOPE AND A SURROUNDING SHROUD

BACKGROUND OF THE INVENTION

1. Field of the Invention

This invention relates to a vehicle headlamp having as its light source a metal-halide discharge lamp comprising an inner envelope and a surrounding light-transmitting shroud integral with the inner envelope. The invention also relates to a discharge lamp per se of this type.

2. Background of the Disclosure

In U.S. Pat. No. 4,935,668—Hansler et al, there is disclosed and claimed a type of metal-halide lamp that comprises (i) a quartz inner envelope within which an electric discharge, or arc, is developed and (ii) a tubular glass or quartz shroud surrounding the inner envelope and spaced therefrom along a portion of the shroud length. The tubular shroud is sealed at predetermined locations along its length to the inner envelope, and the space between the shroud and the inner envelope constitutes a sealed chamber that is either evacuated or gas filled, depending upon the particular application of the lamp. The shroud and the sealed chamber serve a number of important functions which are discussed in detail in the patent. Generally speaking, one of these functions is to make the temperature of the inner envelope higher and more uniform during lamp operation, and another is to keep the shroud relatively cool in comparison to the inner envelope during lamp operation.

The ability to accomplish the results desired from the shroud and the vacuum chamber or gas chamber depends materially upon the nature of the joints or seals formed between the shroud and the inner envelope. A discharge lamp, being a diffuse light source, inherently produces a headlamp beam with lower seeing-to-glare ratio (SGR) than a filament lamp. Further, when a shroud is added to the discharge lamp, the light reflected and refracted from the shroud can significantly add to the glare light, reducing the SGR to undesirable levels. The refracted light comes primarily from the junctions between the bulbous light-emitting region and the cylindrical legs of the shroud, as well as from the shroud-to-arctube seal regions.

In European Patent Application Publication 0 465 083A2—Biel et al, which is assigned to the assignee of the present invention, there is disclosed and claimed a type of seal that can be advantageously used in these locations since, among other things, it is a high quality seal that can be quickly made with very little heat, with a low risk of damaging inner envelope components, and with little change in the thermal characteristics of the lamp in the seal region should there be slight variations in the process of making the seal. This seal comprises a disk-shaped enlargement formed in a tubular portion of the inner envelope by first heating a localized region of the tubular portion to its softening point and then subjecting this region to an abrupt, longitudinally-applied compressive force that drives the softened quartz material radially outward into a disk formation (which we refer to herein as a "maria"). Then the disk-shaped enlargement, or maria, is positioned in alignment with a predetermined surrounding portion of the shroud slightly radially spaced therefrom, following which the predetermined surrounding shroud portion is heated and thus softened and caused to collapse about the outer periphery of disk-shaped enlargement, thereby forming the desired seal at the outer periphery of the disk-shaped enlargement. This type of seal we refer to herein as a "maria seal".

While a maria seal has many advantages, it is subject to the disadvantage that light passing therethrough tends to be scattered. Being at the outer periphery of a disk-shaped enlargement, which typically has a relatively large diameter, the maria seal has been located in prior discharge lamps in a position where it would increase the amount of scattered light in the utilized light output from the discharge lamp. The effect of this in a headlamp system that includes such a discharge lamp is to increase the amount of glare present in the headlamp beam, which is a decidedly undesirable effect. Our invention, in one of it aspects, is concerned with overcoming this disadvantage while retaining most of the advantages of a large-diameter maria seal. Other aspects of the invention are pointed out in the last two paragraphs of the following "Summary".

SUMMARY OF THE INVENTION

The present invention advantageously directs the shroud reflections referred to above by shifting the shroud vertically relative to the arctube, and shaping the shroud so as to place the junctions and seals sufficiently far from the arc source that the light used to create the headlamp beam does not pass through the junctions or seals. In a preferred embodiment of an automobile headlamp, the shroud will have a compound shape being ellipsoidal at one end and spherical or aspherical at the other. In carrying out our invention in one form, we utilize a large-diameter maria seal in the discharge lamp of our headlamp system, but we employ it only in a location where it will not significantly increase the amount of glare appearing in the headlamp beam. More specifically, we provide a headlamp comprising a reflector having an optical axis along which light is reflected from the reflector; and within the headlamp we provide a discharge lamp that comprises an inner envelope having a longitudinal axis substantially coinciding with said optical axis and upon which a light emitting, electric arc discharge is developed. The inner envelope includes a hollow bulbous portion and two tubular portions, or legs, extending in opposite directions from the bulbous portion. One of these tubular portions (i.e., a front tubular portion) extends along the optical axis of the reflector from the bulbous portion toward the front of the headlamp, and the other tubular portion (i.e., a back tubular portion) extends along the optical axis from the bulbous portion toward the reflector. The discharge lamp further comprises a tubular shroud surrounding the inner envelope and having first and second hollow portions at its opposite ends, with a bulbous portion located between said hollow portions, the first hollow portion surrounding the front tubular portion, or front leg, of the inner envelope and the second hollow portion surrounding the back tubular portion, or back leg, of the inner envelope. We provide a large-diameter maria only on the front tubular portion of the inner envelope and join the shroud to this front tubular portion by a maria seal located at the outer periphery of this maria. The shroud is joined to the back tubular portion of the inner envelope by a low-profile seal located between the second hollow portion of the shroud and the back tubular portion. This latter seal includes no maria, or, alternatively, it may include a maria of small diameter compared to the large-diameter maria. In either case, the low profile seal is of a substantially smaller diameter than the large-diameter maria seal, being located much closer to the longitudinal axis of the inner envelope than is the large-diameter maria seal.

The bulbous portion of the shroud has a back zone that is located between the discharge within the inner envelope and the reflector, and it is through this back zone that most of the light used in the headlamp beam is transmitted from the discharge to the reflector. Because the rear shroud-to-inner envelope seal is of a relatively small diameter, it is located outside the path of most of the light transmitted from the discharge to the reflector and thus does not scatter or distort this light. Moreover, this reduced seal diameter allows the back zone of the bulbous portion of the shroud to be extended further toward the axis of the inner envelope, allowing us to provide in this extended region a more nearly ideal shroud shape that permits light to be transmitted through the extended region without substantial scattering or distortion. In one embodiment of the invention, this back zone is of a generally ellipsoidal configuration and, more specifically, an ellipsoidal configuration substantially conforming to a portion of the surface of an ellipsoid having its center near the axis of the inner envelope.

The headlamp further includes a substantially non-reflective shield at the front of the discharge lamp which is so located and of such a size that it blocks direct light from the discharge lamp from exiting the headlamp in the region located above the optical axis of the headlamp reflector, absorbing such direct light and thus reducing glare in the headlamp beam. The above-described large-diameter maria seal of the discharge lamp is located in the path of direct light traveling between the discharge within the inner envelope and this shield. Even though the large-diameter maria seal does produce some scattering of the direct light passing therethrough, this does not significantly increase the amount of glare in the headlamp beam because this light is essentially unused in the portion of the headlamp output that exits the headlamp above the optical axis of the headlamp reflector.

In accordance with another feature of the invention, the bulbous portion of the shroud has its central axis upwardly offset by a small distance from the longitudinal axis of the inner envelope on which the discharge is located. The presence of this offset has been found to substantially increase the ratio of the seeing light to the glare light (i.e., the SGR) in the headlamp beam.

In a modified form of our invention, we include a shroud of substantially the above-described configuration around the inner envelope and in radially-spaced relation to the inner-envelope, but we do not employ a maria on the front leg of the inner envelope for locating the shroud with respect to the inner envelope, relying, for example, upon the low-profile joint between the back leg of the inner envelope and the shroud for performing this locating function. While losing some of the advantages of the above-described large-diameter maria seal on the front leg of the inner envelope, we are able to retain many of the advantageous optical features of our shroud, which features are based, to a large extent, upon the shape and location of the shroud relative to the inner envelope. In such a modified form of the invention, the shroud can serve, among other functions, as a means for suppressing ultra-violet radiation emitted by the discharge lamp, assuming the shroud material is appropriately treated or formulated for ultra-violet suppression. In this modified form, the space between the shroud and the inner envelope may or may not be sealed, depending upon the particular functions desired from the shroud and space.

Another, and in some respects a broader, way of summarizing the invention is as follows. A fundamental problem that the inventjon is concerned with is improving the seeing-to-glare ratio (SGR) of a headlamp that includes as its light source a shrouded discharge lamp. A discharge lamp, being a diffuse light source, inherently produces a headlamp beam, with lower seeing-to-glare ratio (SGR) than a filament lamp. Further, when a shroud is added to the discharge lamp, the light reflected and refracted from the shroud can significantly add to the glare light and thus reduce the SGR to undesirable levels. The refracted light comes primarily from the junctions between the bulbous light-emitting region and the hollow leg portions of the shroud, as well as from the shroud-to-inner-envelope seal regions. We significantly improve the SGR of the shrouded discharge lamp, first, by advantageously directing the reflections by shifting the shroud vertically relative to the inner envelope, and secondly, by shaping the shroud so as to place the junctions and seals in such locations with respect to the arc source that the light used to create the headlamp beam does not pass through the junctions or seals.

BRIEF DESCRIPTION OF THE DRAWINGS

For a better understanding of the invention, reference may be had to the following detailed description taken in connection with the accompanying drawings, wherein.

DETAILED DESCRIPTION

Figure 1:
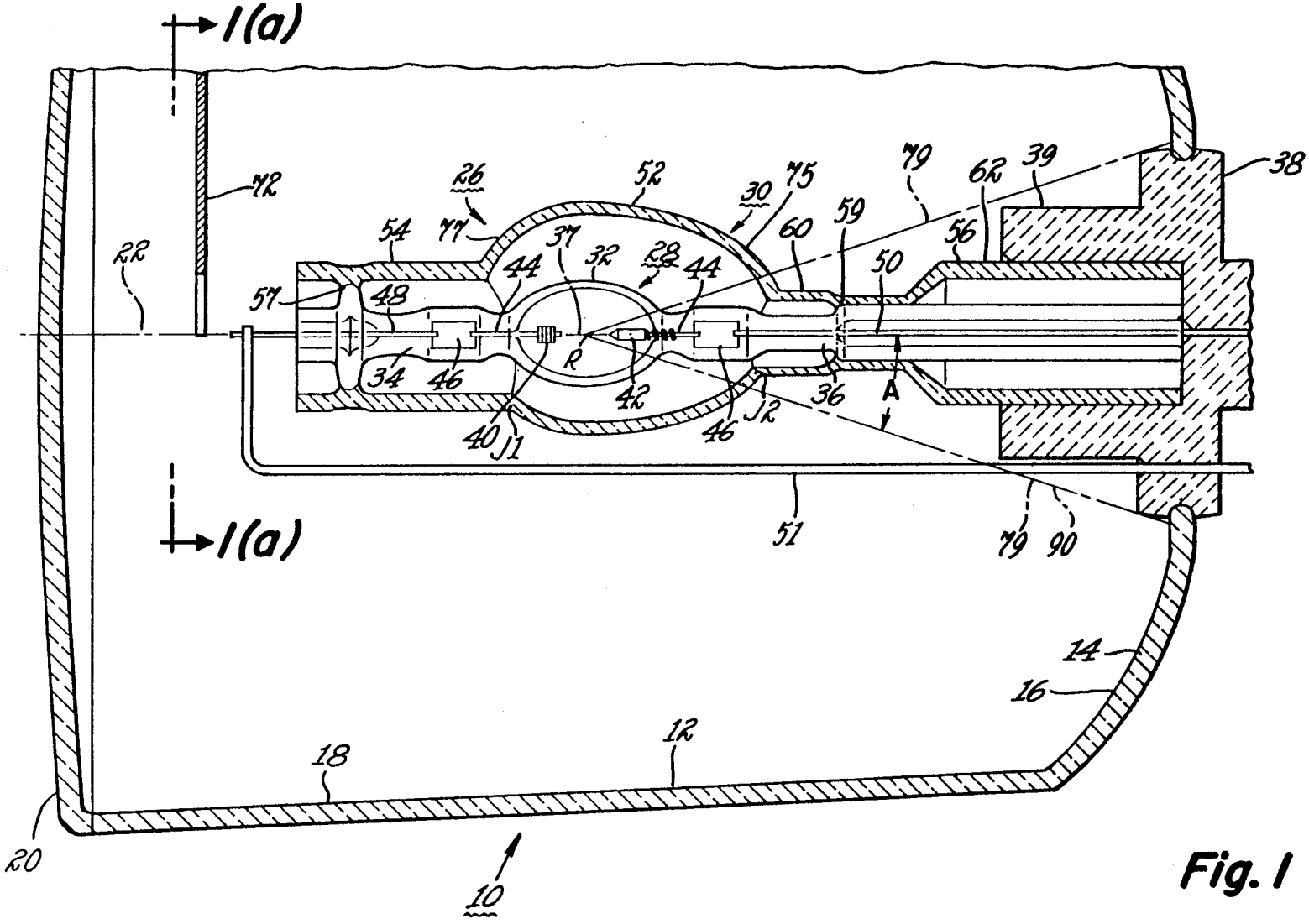
FIG. 1 is a sectional view of a vehicle headlamp embodying one form of the invention and having as its light source a metal-halide discharge lamp that includes an inner envelope and a surrounding shroud.

Referring now to FIG. 1, there is shown a vehicle headlamp 10 that comprises a housing 12 comprising a reflector portion 14 having an internal reflective surface 16 preferably of paraboloidal configuration. The housing 12 further includes a portion 18 of generally rectangular cross-section at the front of the paraboloidal reflector 14. At the front of this rectangular portion 18 is a light-transmitting lens 20. The reflector 14 has an optical axis 22, parallel to which light generated within the lamp is reflected from the reflector to the lens 20, as will soon appear more clearly.

For generating such light, the headlamp includes an arc discharge lamp 26, preferably of the metal-halide type, that comprises an inner envelope 28 and a tubular shroud 30 surrounding the inner envelope and integrally joined thereto. The inner envelope 28 and the shroud 30 are, preferably, both of quartz.

The inner envelope comprises a hollow bulbous central portion 32 and two tubular portions, or legs, 34 and 36 joined to and extending in opposite directions from the bulbous portion 32. The front tubular portion 34 extends along the optical axis 22 of the reflector from the bulbous portion toward the lens, and the back tubular portion 36 extends along the optical axis from the bulbous portion 32 toward the reflector 14. In the embodiment shown in FIG. 1, the inner envelope 28 has a central longitudinal axis 37 and is mounted within the housing 12 in such a position that this central longitudinal axis 37 substantially coincides with the optical axis 22 of the reflector. Central longitudinal axis 37 is sometimes referred to herein as the optical axis of the discharge lamp.

Within the bulbous portion 32 is a pair of spaced-apart electrodes 40 and 42 between which an electric discharge, or arc, extending along axis 37 is developed when the lamp is operated. As will soon appear more clearly, this discharge serves as the light source for the headlamp. The electrodes 40 and 42 respectively have rod portions 44 that extend along axis 37 into the adjacent tubular portions of the inner envelope, where they are supported on the quartz of the tubular portions. At the outer end of each rod portion 44 is a conventional foil seal that comprises a foil element 46 suitably joined at one end to the rod portion and joined at its opposite end to a lead wire (48 or 50) which extends through the associated tubular portion to an outer end of the inner envelope. Each of these foil seals is formed in a conventional manner, as by positioning it within its associated tubular leg (34 or 36) and heating and softening the surrounding quartz of the leg and suitably compressing this quartz about the foil element.

The tubular shroud 30 also has a bulbous central portion (52) and two hollow portions (54 and 56) at opposite sides thereof extending generally parallel to the optical axis 22 of the reflector. Hollow portion 54 of the shroud surrounds the tubular portion 34 of the inner envelope, and hollow portion 56 of the shroud surrounds the tubular portion 36 of the inner envelope. The shroud is radially spaced from the inner envelope along most of the shroud length and is sealed to the inner envelope at two spaced-apart locations 57 and 59. The space between the shroud and the inner envelope that is situated between the two seal locations 57 and 59 constitutes a sealed chamber, which in one embodiment is evacuated to a hard vacuum. As pointed out hereinabove, this evacuated chamber serves during lamp operation to make the temperature of the inner envelope higher and more uniform and also to keep the shroud relatively cool in comparison to the inner envelope. The shroud, if appropriately treated or formulated, can serve additional functions, such as ultra-violet radiation suppression.

Figure 1A:
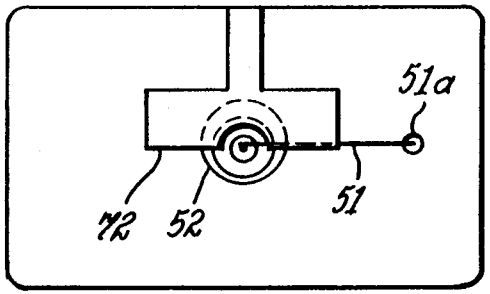
FIG. 1*a* is a reduced-size sectional view of the headlamp of FIG. 1 taken along the line 1*a*—1*a* of FIG. 1.

For supporting the discharge lamp 26 within the housing 18 in the position illustrated in FIG. 1, a centrally-located mounting device 38, preferably of a suitable high-temperature resistant polymer, is fitted within an opening in the reflector 16. This mounting device 38 includes a sleeve 39 at its left-hand side that is concentric with optical axis 22 and tightly receives the right hand end of the tubular shroud portion 62, thus securely fixing the discharge lamp 26 to the reflector 14 in the desired position. One lead wire 50 of the discharge lamp extends in sealed relationship through the center of the mounting device to a first electrical terminal (not shown) outside the housing 12. Another wire 51 extends in sealed relationship through the mounting device 38 between a second external terminal (not shown) and the left hand end of the other lead wire 48 of the discharge lamp. The two wires 50 and 51 connect the discharge lamp in a suitable vehicle-lighting circuit in a conventional manner. In FIG. 1, to simplify the drawing, the wire 51 is shown located beneath the discharge lamp 26, but a preferred location for it is to one side of the discharge lamp as illustrated by the circle 51*a* in FIG. 1*a*.

The shroud 30 is formed separately from the inner envelope 28, preferably starting with quartz tubing having the same inner and outer diameters as the front hollow portion 54 of the shroud. The bulbous central portion of the shroud is preferably formed by heating and softening the original tubing in this region and then blowing this softened quartz radially outwardly into a mold having an internal configuration corresponding to the illustrated external configuration of the bulbous center portion.

The back hollow portion 56 of the shroud has an inner region 60 of restricted diameter and an adjacent outer region 62 of the same relatively large diameter as the original tubing. In the shroud-making process, the diameter of the original quartz tubing is reduced in the inner region 60 in a conventional manner, as by heating, softening, and drawing this region until its outer diameter relative to that of the original tubing is reduced to slightly less than that represented in FIG. 1. The final configuration is established by blowing this softened, reduced region radially outward into a surrounding suitably-shaped, but restricted, extension of the same mold as used for the bulbous portion 52 of the shroud. The original tubing is left intact to form the adjacent region 62 and also to form the front hollow portion 54.

Figure 2:
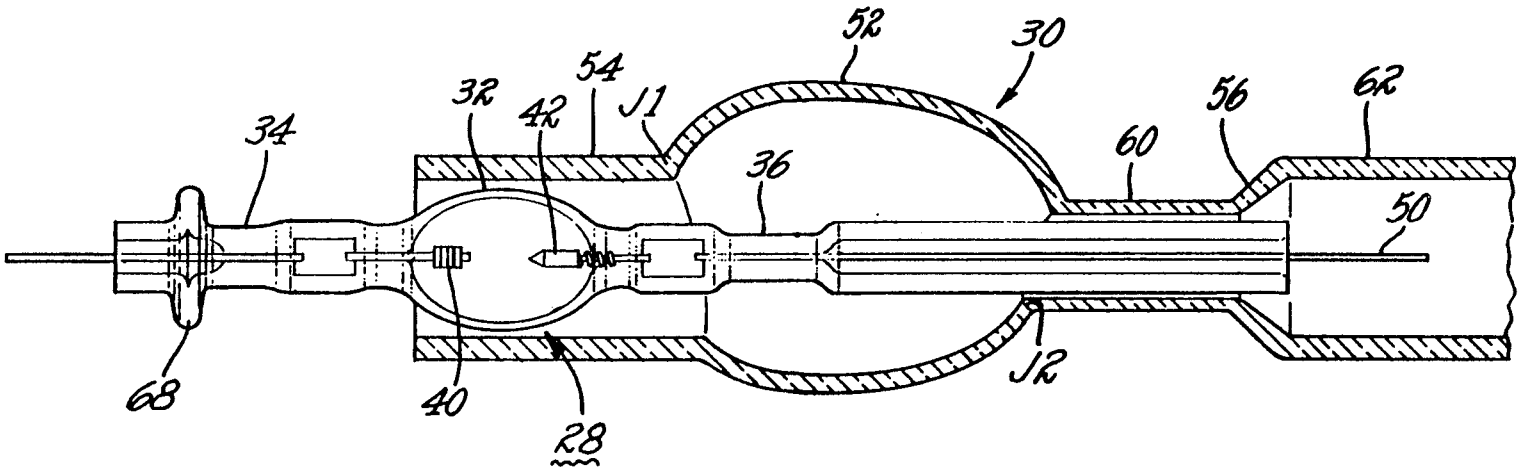
FIG. 2 is a simplified sectional view of the discharge lamp components while they are being assembled together and before being incorporated into the headlamp of FIG. 1.

In FIG. 2, the inner envelope 28 and the separately-formed shroud 30 are shown while they are being joined together and before being incorporated into the headlamp. It will be noted that the tubular portion 34 of the inner envelope has a relatively large-diameter disk-shaped enlargement 68 formed therein. This enlargement 68, which is referred to herein as a large-diameter "maria," is formed by first heating a localized region of the quartz tubular portion 34 to its softening point and then subjecting this region to an abrupt, longitudinally-applied compressive force that drives the softened quartz radially outward into a disk formation of relatively large diameter. This method of formation is disclosed in more detail in European Patent Publication 0 465 083A2—Biel et al, cited hereinabove. When the shroud 30 is later slipped over the inner envelope 28, as shown in FIG. 2, the hollow front portion 54 of the shroud is ultimately positioned in alignment with the maria 68 in the position shown in FIG. 1. Only a very small radial clearance is then present between the outer periphery of the large-diameter maria 68 and the surrounding bore of the hollow shroud portion 54. Then the aligned hollow shroud portion is suitably heated and thus softened and caused to collapse about the outer periphery of the large-diameter maria, thereby forming the desired seal at 57 between the outer periphery and the surrounding shroud portion. A seal at the outer periphery of a maria, we refer to herein as a "maria seal".

As noted hereinabove and in the above-cited European Patent Publication 0 465 083A2, a large-diameter maria seal has many advantages, but it is subject to the disadvantage that light passing therethrough tends to be scattered. Because the large-diameter maria seal is at the outer periphery of a large-diameter disk-shaped enlargement, it has typically been located in prior discharge lamps in a location where it tends to increase the amount of scattered light in the utilized light output from the discharge lamp; and this tends to increase the amount of glare present in the headlamp beam.

We overcome this problem by employing the large-diameter maria seal in a location where it will not significantly increase the amount of glare in the headlamp beam. In this connection, note that only a single large-diameter maria seal is utilized in the discharge lamp of FIG. 1, and this seal is located only at the front of the discharge lamp. Note further that there is a black, or non-reflective, shield 72 (intended to reduce glare) at the front of the discharge lamp that absorbs direct light from the discharge within the lamp, thereby blocking such direct light from exiting directly through the front of the headlamp in the region of the headlamp located above the optical axis 22 of the reflector. Accordingly, though direct light from the discharge may pass through the large-diameter maria seal and thus be scattered by this maria seal, this does not significantly affect the amount of glare present in the headlamp beam because this direct light, being blocked and absorbed by the non-reflective shield 72, is basically not utilized in the headlamp beam. Though direct light from the discharge may pass through the portion of the large-diameter maria seal located below the optical axis 22, with some resultant scattering, very little of this light will appear as glare in the headlamp beam. Most of this light exits the headlamp via its region below the optical axis 22 and is used to slightly increase the light on the roadway just ahead of the vehicle.

At the back of the discharge lamp, we utilize a seal that either includes no maria or a maria of very small outer diameter compared to that of the large diameter maria seal at the front of the discharge lamp. This back seal (at 59), which we refer to as a low-profile seal, has a substantially smaller diameter than the large-diameter maria seal and is located much closer to the central axis 37 of the discharge lamp. This low-profile seal is made between the restricted region 60 of the back hollow portion 56 of the shroud and the tubular leg 36 of the inner envelope. This seal is made by heating, softening, and thereafter collapsing this restricted region about the tubular leg 36 in a conventional manner. Only a modest amount of heat is required for this sealing operation inasmuch as the restricted region 60 is introduced into the shroud when it is initially formed and before the shroud is slipped over the inner envelope, as will be apparent from FIG. 2. Thus, the seal at 59 can be made without necessitating the prolonged heating needed for a large reduction in the diameter of the pertinent shroud region (60) when the shroud is in place. The reduced heat requirement reduces the risk of any heat damage to components of the inner envelope, such as the foil seal, and also reduces the chances that small variations in the seal-making process will produce undesirably large variations in the thermal characteristics of the lamp in this region.

Figure 5:
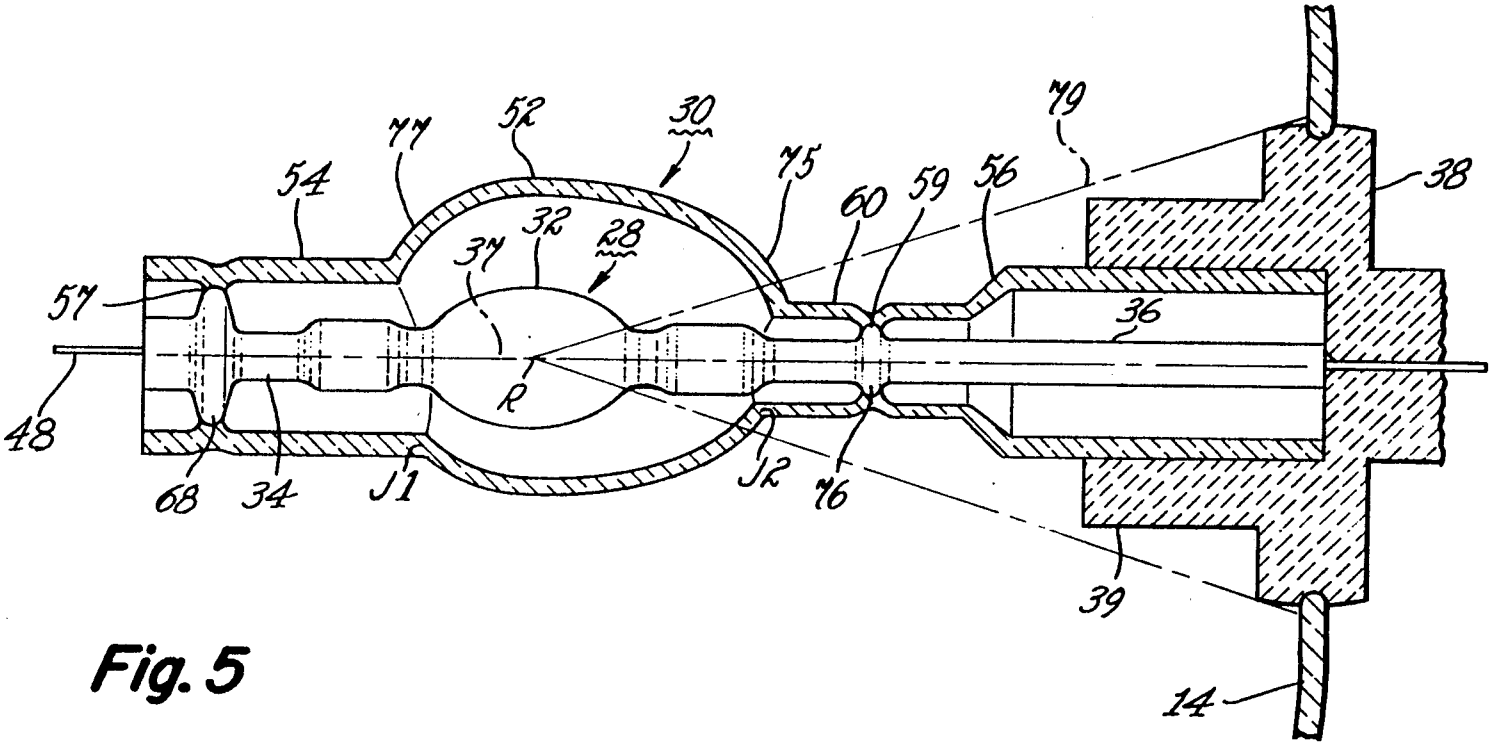
FIG. 5 illustrates a discharge lamp embodying a modified form of our invention.

FIG. 5 illustrates a modified low-profile seal comprising a small-diameter maria 76. The maria of this seal is formed in generally the same way as the large diameter maria 68 at the front of the discharge lamp, but the compressive force for forming the maria 76 is applied for a much smaller distance to the leg 36 of the inner envelope, and this results in producing only a very small enlargement, e.g., projecting only about 0.5 mm from the nearby outer periphery of the leg 36, as compared to the approximately 1.5 mm projection on the front leg. The hollow portion 60 of the shroud closely surrounds the small-diameter maria when the shroud is assembled over the inner envelope, and only a small amount of heat is used for collapsing the aligned hollow portion 60 about the small diameter maria to form the seal at 59. The use of a small-diameter maria is advantageous as compared to the design of FIG. 1 because the presence of the small-diameter maria enables a high quality seal to be made in this location with less chance for introducing potentially damaging stresses in the leg of the inner envelope adjacent the seal 59.

Most of the light used in the headlamp beam is light that is transmitted from the discharge within the bulbous portion 32 to the reflector 14 via the back zone 75 of the bulbous portion of the shroud. Partially because the rear shroud-to-inner envelope seal (at 59) is of relatively small diameter, it is located outside the path of most of the light transmitted from the discharge to the reflector and thus does not scatter or distort this light. Moreover, this reduced seal diameter allows the back zone 75 of the bulbous portion of the shroud to be extended further toward the central axis 37 of the inner envelope, allowing us to provide in this extended region a more nearly ideal shroud configuration that permits light to be transmitted through the extended region without substantial scattering or distortion.

With respect to this latter point, we form the back zone 75 of the bulbous portion of the shroud of a generally ellipsoidal configuration and, more specifically, an ellipsoidal configuration substantially conforming to a portion of the surface of an ellipsoid having its center near the inner envelope axis 37 and midway between the electrodes 40 and 42.

The front zone 77 of the bulbous portion of the shroud we form of a generally spherical configuration and, more specifically, a spherical configuration substantially conforming to a portion of the surface of a sphere having its center near the lamp axis 37 and midway between the electrodes 40 and 42. Employing a spherical shape for the front zone 77 of the shroud is advantageous for a number of reasons. First, the spherical configuration allows light from the source to pass through this region with very little distortion or scattering since the inner and outer surfaces of the spherical portion are substantially perpendicular to the light rays arriving from the source, which follow substantially radially-extending paths from the source. The reduced distortion and scattering in this region allows the shield 72 to more effectively perform its intended direct-light blocking and absorbing function since more light arrives in the shield region along predictable paths where the shield can be located. If scattering and distortion are prevalent, more light bypasses the shield and ends up as glare light. Secondly, although there is inherently some reflection of these light rays at the spherical inner and outer surfaces, the spherical configuration forces these reflected rays to be directed back toward the source along substantially the same paths as they arrived by. This enables these reflected rays, after returning through the source, to exit through the back 75 of the shroud via substantially the same paths as rays directly from the source, thus simplifying the optics requirements for this back region.

While the ellipsoidal shape of the back zone 75 of the bulbous portion of the shroud produces slightly more optical distortion of the light passing therethrough than a spherical shape would, the ellipsoidal shape in this location has the advantage of moving the junction J2 between the bulbous portion 52 of the shroud and the leg 56 of the shroud further from the arc source along the central longitudinal axis 37 of the lamp, thus decreasing the chances that there will be useful light passing therethrough which could be scattered by the junction. With respect to the remoteness of the junction J2 between bulbous portion 52 and leg 56 relative to the arc source, it is noted that the distance between this junction J2 and a reference point R located on optical axis 37 midway between electrodes 40 and 42 is much greater than the distance between R and the junction J1 between the spherical portion 77 of the shroud and its adjacent shroud leg 54.

Referring to FIG. 1, a significant feature with respect the location of junction J2 is that J2 is located inside a conical reference envelope 79 generated by a reference line 90 revolved about the optical axis 37 of the discharge lamp 26. This reference line 90 is a straight line located below the optical axis 37, extending between the reference point R and the reflector and disposed at a minimum included angle A with respect to the optical axis 37 without intersecting the lamp-mounting structure 38. This location of junction J2 (i.e., inside conical reference envelope 79) results in substantially all light rays emitted by the discharge and travelling directly to the reflector 14 avoiding the junction J2, thus maintaining such rays essentially free of the glare component that would result if these rays were required to pass through junction J2.

One measure of a headlamp's efficacy is its seeing-to-glare ratio (SGR). This is determined by (i) measuring with a goniometer the seeing and the glare components of the light emerging from the headlamp when the headlamp is set for low-beam operation and (ii) then dividing the seeing component by the glare component. The seeing component refers to the light intensity (looking out from the headlamp) at a point located 0.5 degree below a horizontal reference line extending transversely of the headlamp at its optical axis and 1.5 degrees to the right of a vertical reference line extending transversely of the headlamp at the center of the roadway. The glare component refers to the maximum intensity along a horizontal line 0.5 degree up from the above-noted horizontal reference line.

Figure 3:
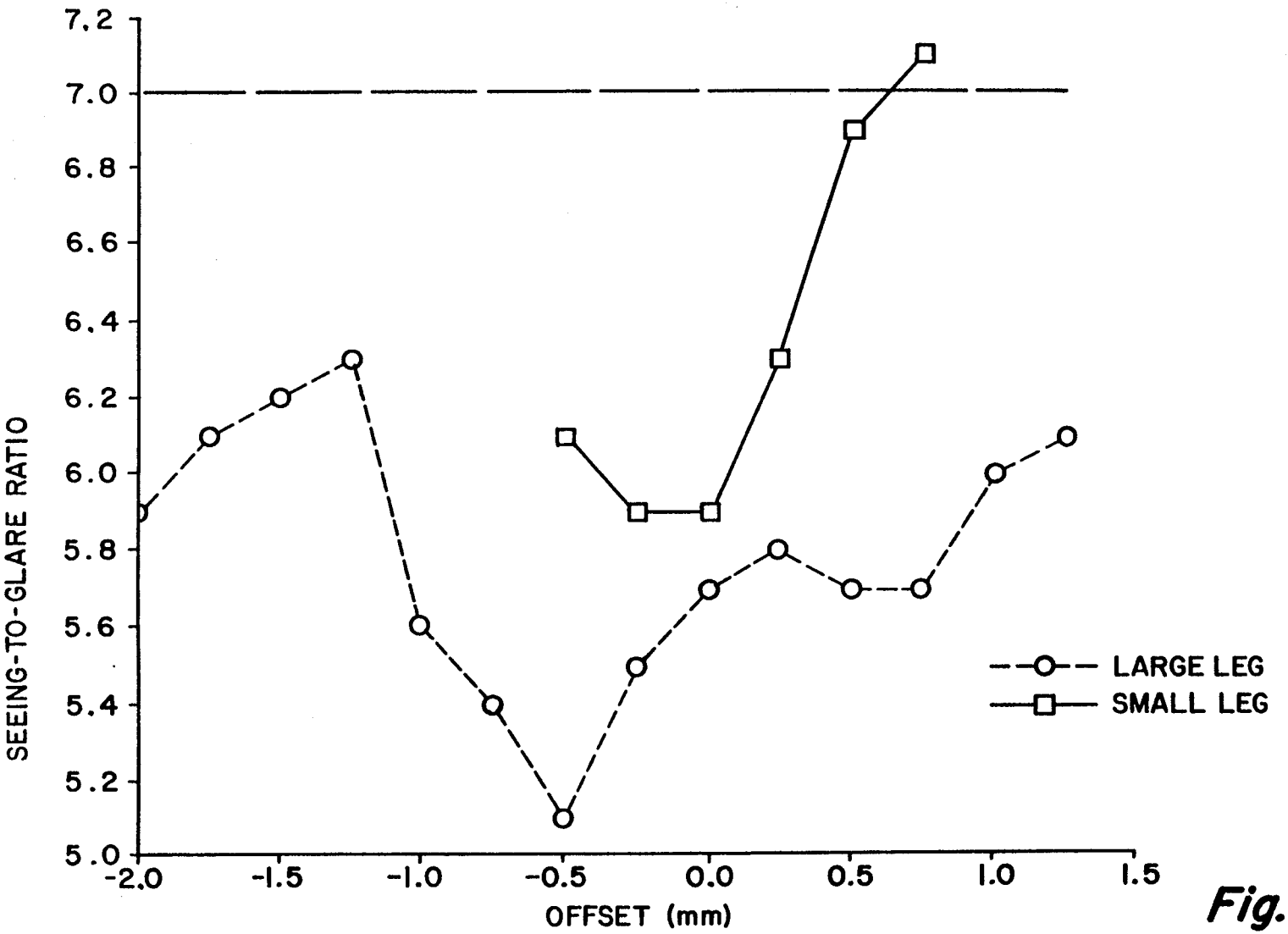
FIG. 3 is a graph that shows the effect on seeing-to-glare ratio (SGR) of offsetting the central longitudinal axis of the bulbous portion of the shroud with respect to the central longitudinal axis of the inner envelope, where the discharge, or arc, is normally located during lamp operation. The top curve depicts results obtained using a discharge lamp corresponding to that illustrated herein, and the lower curve depicts results obtained using a discharge lamp corresponding to the double large-diameter maria lamp of the aforesaid Biel et al application. In neither case was there present a direct light shield, such as 72 of FIG. 1.

We have studied this seeing-to-glare ratio (SGR) using as a test sample a headlamp having various discharge lamps present therein in the position and with the orientation shown in FIG. 1. Our studies indicate (i) that a headlamp corresponding to that depicted but with no shroud present in the discharge lamp has an SGR of about 6.9 and (ii) that the addition of a shroud to the discharge lamp, as a general rule, substantially lowers the SGR of the headlamp. We also have found that the SGR is sensitive to the vertical offset of the axis of the bulbous portion 52 of the shroud from the central longitudinal axis 37 of the inner envelope. In our illustrated headlamp, offsetting the axis of the bulbous portion upwardly by 1.0 mm from a zero offset position has increased the SGR from about 6.0 to slightly above 7.0. In contrast, when a shroud of the general configuration depicted in FIG. 1 of the aforesaid Biel et al European Patent Publication 0 465 083A2, i.e., with large diameter hollow portions at both ends of the lamp (to accommodate large-diameter marias on both legs of the inner envelope), was added to the unshrouded lamp, the SGR of the headlamp fell from 6.9 to about 5.6. Offsetting the central axis of that shroud upwardly by 1.0 mm increased the SGR, but only to about 6.0. Smaller upward offsets produced even smaller increases in SGR. FIG. 3 is a graph depicting these test results. The upper curve (designated the small leg curve) illustrates the performance of a headlamp using a discharge lamp including a shroud having the shape and location illustrated herein. The lower curve (designated the large leg curve) illustrates the performance of a headlamp using a discharge lamp including a shroud having the general shape and location depicted in FIG. 1 of the aforesaid European Patent Publication 0 465 083A2—Biel et al. In neither of these test series was there present a direct light shield, such as 72 and in FIG. 1 hereof, the presence of such a shield being considered unnecessary to compare the SGR performance of the two headlamps. Also in neither of these test series was there present between the shroud and the inner envelope intervening support structure. The inner envelope was supported independently of the shroud to enable it to be moved independently of the shroud to effect different vertical offsets.

Summarizing our SGR findings, we have found that with the illustrated headlamp we can substantially equal or exceed the SGR of the headlamp with an unshrouded discharge lamp if we offset the axis of the bulbous portion 52 of the shroud by about 0.5 to 1.5 mm from the central axis 37 of the inner envelope. These results were obtained with a shroud having a bulbous portion with an outer diameter of about 14 mm. at its largest diameter location and with a paraboloidal reflector having a focal length of $\frac{7}{8}$ inch.

Figure 4:
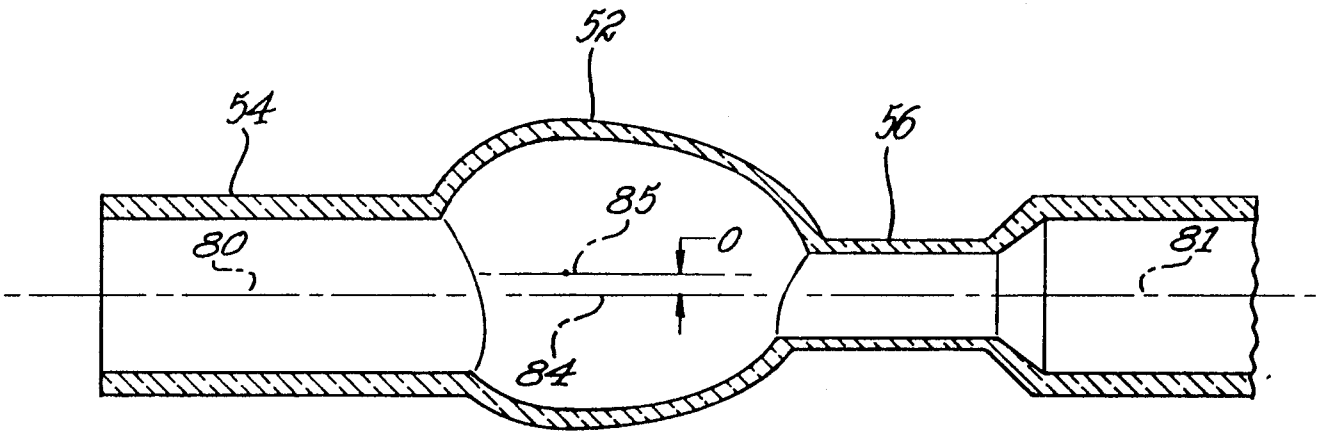
FIG. 4 is a simplified drawing of the shroud alone, illustrating the offset relationship between the axis of the bulbous portion of the shroud and the axis of the hollow legs of the shroud.

In one form of the invention, we achieve the desired offset of the axis of the bulbous portion 52 of the shroud from the axis 37 of the inner envelope 28 by providing during the above-described shroud-molding process an offset between the central axis of the bulbous portion 52 and the central axis of the two hollow portions 54 and 56 of the shroud. As shown in FIG. 4, the axes of the two hollow portions, depicted at 80 and 81, are colinear and are disposed along a central reference line 84, but the axis of the bulbous portion, depicted at 85, is slightly offset in a vertically upward direction from this central reference line 84. This offset 0 is achieved by appropriately shaping the mold that is used for forming the shroud 30.

The shroud is shaped so that the above-described central reference line 84 coincides with the central axis 37 of the inner envelope 28 when the shroud and inner envelope are combined. Thus, the hollow portions 54 and 56 of the shroud are concentric with the respective legs 34 and 36 of the inner envelope. The presence of the large-diameter maria 68 (FIGS. 1 and 2) is of significant assistance in establishing and maintaining this concentricity. Because the maria 68 is relatively large and fits closely within the hollow portion 54 of the shroud, it is able to accurately radially position the shroud on the inner envelope and to hold the desired centered relationship (of coincidence between reference lines 84 and 37) while the maria seal (at 57) is being made. With this assistance from the large-diameter maria seal at the front of the discharge lamp, the low profile seal (at 59) at the back of the discharge lamp is able to provide a sufficient centering effect of the shroud on the inner envelope in this back region to maintain the desired coincidence between reference lines 84 and 37.

Figure 6:
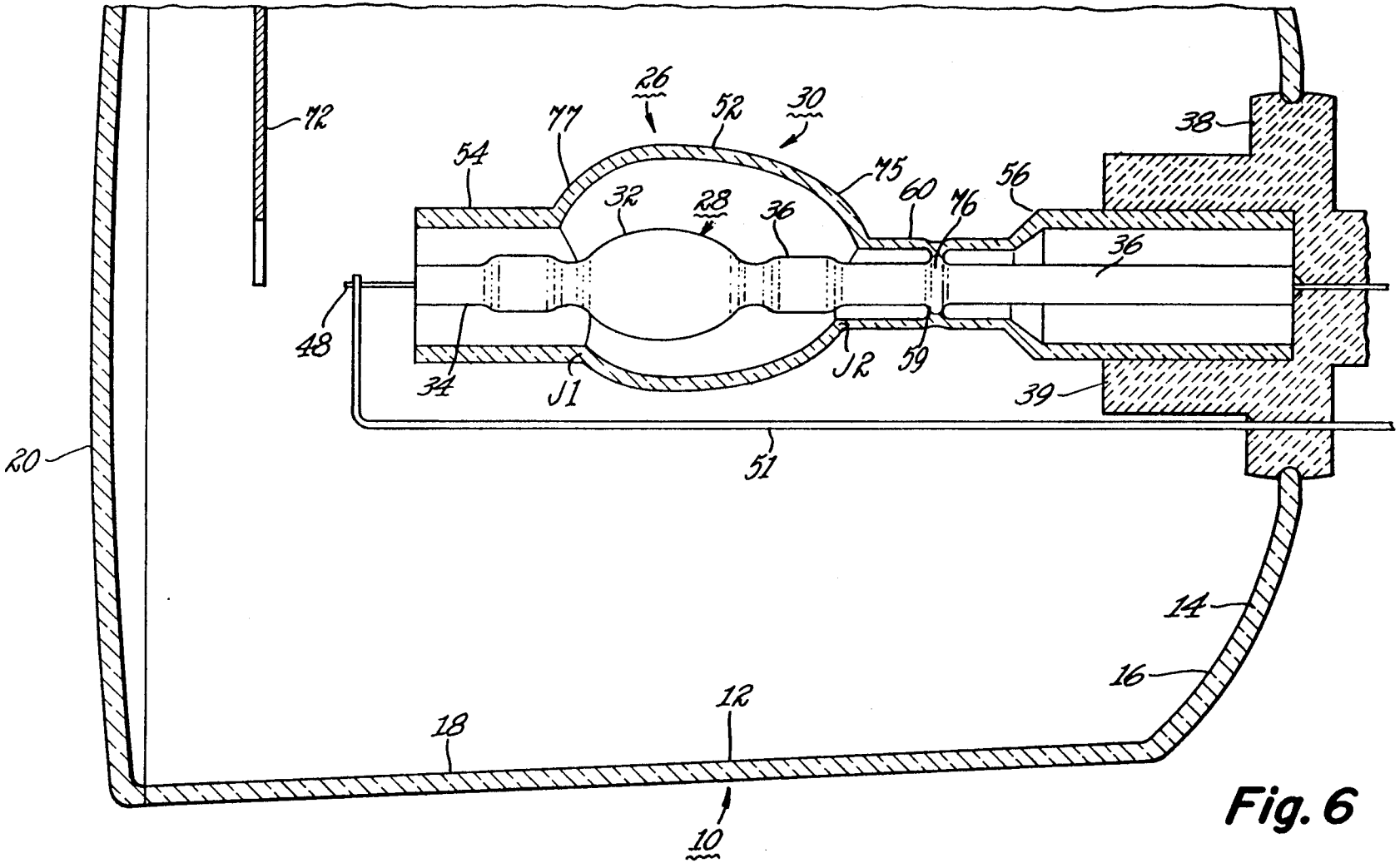
FIG. 6 illustrates still another modified form of our invention.

FIG. 6 shows another modification of our invention, differing in structure from that of FIG. 5 primarily in omitting the large-diameter maria 68 and the main seal at 57 of FIG. 5 and relying upon the low-profile joint at 76, 59 between the back leg 36 of the inner envelope 28 and the shroud 30 for locating these latter components with respect to each other. In this modified embodiment the space between the shroud 30 and the inner envelope 28 is not sealed, the shroud being relied upon primarily for ultra-violet radiation suppression, being formulated of a suitably doped quartz for this purpose. In this modified embodiment, the front zone 77 of the bulbous portion 52 of the shroud is of a substantially spherical configuration, the back portion 75 is of a substantially ellipsoidal configuration, and the central longitudinal axis of the bulbous shroud portion 52 is vertically offset in an upward direction from the optical axis of the discharge lamp 26. These latter three features function in substantially the same manner as described hereinabove in connection with FIG. 1 to provide improved seeing-to-glare ratio performance.

Figure 7:
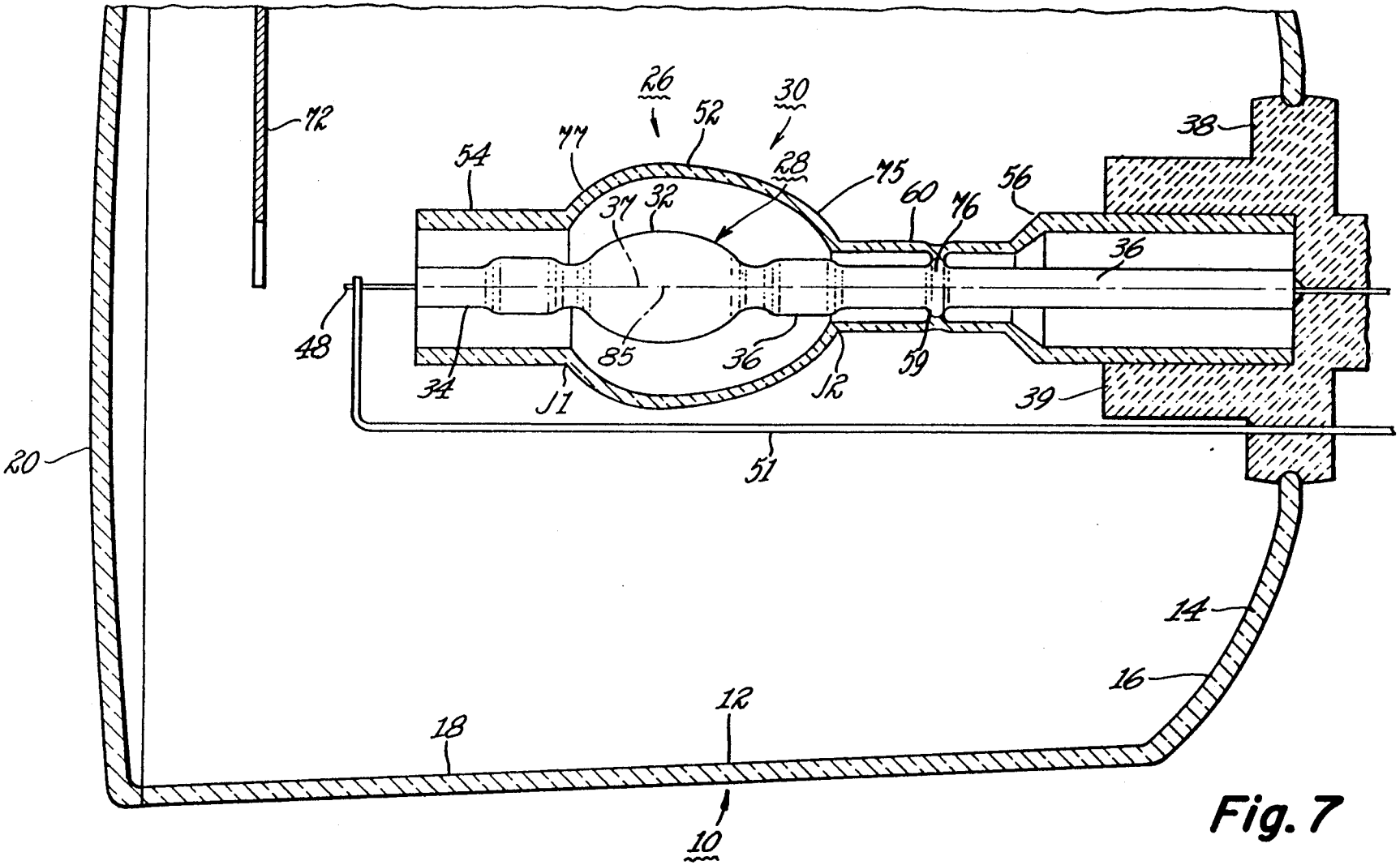
FIG. 7 illustrates still another modified form of our invention.

FIG. 7 is a sectional view of a headlamp similar to the headlamp of FIG. 8 except that in the FIG. 7 headlamp there is no offset between the central axis 37 of the discharge lamp 28 and the central axis 85 of the bulbous portion 52 of the shroud 30. In other words, these axes substantially coincide. The shroud is located with respect to the inner envelope by the low-profile joint at 76,59 corresponding to the similarly designated joint of FIG. 6. Alternatively, the low-profile joint shown in FIG. 1 at 59,36 could be used for this purpose.

In the FIG. 7 embodiment the front zone 77 of the bulbous portion 52 of the shroud is of a substantially spherical configuration, and the back zone 75 is of a spherical configuration, and the back zone 75 is of a substantially ellipsoidal configuration. (This combination of configurations we sometimes refer to herein as the compound shape of the bulbous portion 52 of the shroud.) Seeing-to-glare measurements made on the FIG. 7 headlamp (having the compound shape bulbous portion) showed an SGR of 6.7. Seeing-to-glare measurements made on a headlamp corresponding to that of FIG. 7 except having a shroud with a bulbous portion 52 substantially spherical in shape showed an SGR of only about 5.6. Thus, the presence of the illustrated compound shape, of itself, results in a substantial improvement in the seeing-to-glare ratio.

While we have shown and described particular embodiments of our invention, it will be obvious to those skilled in the art that various changes and modifications may be made without departing from the invention in its broader aspects; and we, therefore, intend herein to cover all such changes and modifications as fall within the true spirit and scope of our invention.

What we claim is:

1. In a vehicle headlamp comprising a reflector having an optical axis along which light is reflected from the reflector forwardly thereof, a lens at the front of the reflector for receiving and transmitting said reflected light, and a metal-halide discharge lamp mounted in a position between said reflector and said lens for generating said reflected light, said discharge lamp comprising:

(a) an inner envelope comprising:

(a1) a hollow bulbous portion of vitreous light-transmitting material containing a fill, (a2) two tubular portions of vitreous material joined to and extending in opposite directions from said bulbous portion, a front one of said tubular portions extending along said optical axis from said bulbous portion toward said lens and a back one of said tubular portions extending along said optical axis from said bulbous portion toward said reflector, (a3) a disk-shaped enlargement on said front tubular portion projecting radially outward therefrom and integral therewith, (b) a pair of spaced-apart electrodes within said bulbous portion of the inner envelope between which an electric discharge is developed when the lamp is operated, (c) means for supporting said electrodes on said tubular portions, (d) a tubular shroud of vitreous material surrounding said inner envelope and comprising first and second hollow portions at opposite ends of the shroud, and a light-transmitting enlarged bulbous portion located between said hollow portions, the first of said hollow shroud portions surrounding and substantially aligned with said disk-shaped enlargement and forming a first seal with the outer periphery of said disk-shaped enlargement, and in which:

(e) said shroud constitutes an outer wall and said disk-shaped enlargement constitutes an end wall of a chamber surrounding the tubular portions and the bulbous portion of said inner envelope, (f) the second of said hollow shroud portions has an outer periphery and an inner periphery surrounding said back tubular portion of the inner envelope, said inner periphery forming a second seal with the outer periphery of said back tubular portion, and (g) the outer and inner dimensions of said second hollow shroud portion at said second seal are substantially smaller than the respective outer and inner dimensions of said first hollow shroud portion at said first seal.

2. A headlamp as defined in claim 1 in which said back tubular portion of the inner envelope includes a small-diameter enlargement thereon disposed within the inner periphery of said second hollow shroud portion, the second hollow shroud portion forming said second seal with the outer periphery of said small-diameter enlargement, and the diameter of said small-diameter enlargement being substantially smaller than the diameter of said disk-shaped enlargement.

3. A headlamp as defined in claim 1 and further comprising a glare-reducing shield positioned forwardly of said discharge lamp for blocking direct light from said discharge lamp from traveling forwardly of said discharge lamp directly through said lens in the region of said headlamp located above said optical axis, said shield being substantially non-reflecting with respect to said blocked direct light.

4. The headlamp of claim 1 in which:

(a) said discharge lamp has an optical axis surrounded by the bulbous portion of said inner envelope and on which said electrodes are located, (b) said enlarged bulbous portion of the shroud surrounds the bulbous portion of said inner envelope and has an outer wall including a front zone surrounding said lamp optical axis and located adjacent said first hollow shroud portion and a back zone surrounding said lamp optical axis and located adjacent said second hollow shroud portion, (c) said front zone has a configuration substantially conforming to a portion of the surface of a sphere having its center near said lamp optical axis, and said back zone has a configuration substantially conforming to a portion of the surface of a ellipsoid having its center near said lamp optical axis.

5. The headlamp of claim 1 in which:

(a) said discharge lamp has an optical axis surrounded by the bulbous portion of said inner envelope and on which said electrodes are located, (b) a reference point is located on said optical axis of the discharge lamp midway between said electrodes, (c) said enlarged bulbous portion of the shroud surrounds the bulbous portion of said inner envelope, (d) said enlarged bulbous portion of the shroud has a front zone adjoining said first hollow shroud portion and a back zone adjoining said second hollow shroud portion, (e) the junction between said back zone and said second hollow shroud portion is located a substantially larger distance from said reference point than is the junction between said front zone and said first hollow shroud portion.

6. The headlamp of claim 5 in which the junction between said back zone and said second hollow shroud portion is located a substantially smaller distance from said optical axis of the discharge lamp than is the junction between said front zone and said first hollow shroud portion.

7. The headlamp of claim 5 in which said front zone of said bulbous shroud portion has a configuration substantially conforming to a portion of the surface of a sphere having its center near said lamp optical axis, and said back zone has a configuration substantially conforming to a portion of the surface of an ellipsoid having its center near said lamp optical axis.

8. The headlamp of claim 6 in which said front zone of said enlarged bulbous shroud portion has a configuration substantially conforming to a portion of the surface of a sphere having its center near said lamp optical axis, and said back zone has a configuration substantially conforming to a portion of the surface of an ellipsoid having its center near said lamp optical axis.

9. A headlamp as defined in claim 1 and in which:

(a) said discharge lamp has an optical axis surrounded by the bulbous portion of said inner envelope and on which said electric discharge is developed, and (b) said bulbous portion of the shroud has a central longitudinal axis that is offset by a small distance vertically upward from said optical axis of the discharge lamp sufficient to substantially increase the seeing-to-glare ratio of the headlamp as compared to the seeing-to-glare ratio that would be present in an otherwise identical headlamp having no vertical offset between the central longitudinal axis of the bulbous portion of the shroud and the optical axis of the discharge lamp.

10. The headlamp of claim 9 in which the amount of said vertical offset is sufficiently large as to increase the seeing-to-glare ratio of the headlamp by at least 10 percent as compared to a corresponding headlamp with no vertical offset.

11. A headlamp as defined in claim 3 and in which:

(a) said discharge lamp has an optical axis surrounded by the bulbous portion of said inner envelope and on which said electric discharge is developed, and (b) said bulbous portion of the shroud has a central longitudinal axis that is offset by a small distance vertically upward from said optical axis of the discharge lamp sufficient to substantially increase the seeing-to-glare ratio of the headlamp as compared to the seeing-to-glare ratio that would be present in an otherwise identical headlamp having no vertical offset between the central longitudinal axis of the bulbous portion of the shroud and the optical axis of the discharge lamp.

12. A headlamp as defined in claim 4 and in which:

(a) said bulbous portion of the shroud has a central longitudinal axis that is offset by a small distance vertically upward from said optical axis of the discharge lamp sufficient to substantially increase the seeing-to-glare ratio of the headlamp as compared to the seeing-to-glare ratio that would be present in an otherwise identical headlamp having no vertical offset between the central longitudinal axis of the bulbous portion of the shroud and the optical axis of the discharge lamp, and (b) the centers of said sphere and said ellipsoid are located substantially on said offset central longitudinal axis of the bulbous portion of the shroud.

13. A headlamp as defined in claim 5 and in which said bulbous portion of the shroud has a central longitudinal axis that is offset by a small distance vertically upward from said optical axis of the discharge lamp sufficient to substantially increase the seeing-to-glare ratio of the headlamp as compared to the seeing-to-glare ratio that would be present in an otherwise identical headlamp having no vertical offset between the central longitudinal axis of the bulbous portion of the shroud and the optical axis of the discharge lamp.

14. The headlamp of claim 13 in which the junction between said back zone and said second hollow shroud portion is located a substantially smaller distance from the optical axis of the discharge lamp than is the junction between said front zone and said first hollow shroud portion.

15. The headlamp of claim 13 in which:

(a) said front zone of said bulbous shroud portion has a configuration substantially conforming to a portion of a surface of a sphere having its center substantially on said offset central longitudinal axis of the bulbous portion of the shroud, and (b) said back zone has a configuration substantially conforming to a portion of the surface of an ellipsoid having its center substantially on said offset central longitudinal axis of the bulbous portion of the shroud.

16. The headlamp of claim 15 in which the junction between said back zone and said second hollow shroud portion is located a substantially smaller distance from said optical axis of the discharge lamp than is the junction between said front zone and said first hollow shroud portion.

17. A headlamp is defined in claim 5 in which:

(a) mounting structure for mounting said discharge lamp with respect to said reflector is provided within said reflector between said reflector and said discharge lamp, (b) a straight reference line can be constructed below said lamp optical axis from said reference point to said reflector that is disposed at a minimum included angle with respect to said lamp optical axis without intersecting said mounting structure, (c) a conical reference envelope is generatable by revolving said reference line about said lamp optical axis, and (d) said junction between said back zone and said second hollow shroud portion is located within said conical reference envelope.

18. A headlamp as defined in claim 17 in which said front zone of said bulbous shroud portion has a configuration substantially conforming to a portion of the surface of a sphere having its center near said lamp optical axis, and said back zone has a configuration substantially conforming to a portion of the surface of an ellipsoid having its center near said lamp optical axis.

19. A headlamp as defined in claim 18 in which said bulbous portion of the shroud has a central longitudinal axis that is offset by a small distance vertically upward from said optical axis of the discharge lamp sufficient to substantially increase the seeing-to-glare ratio of the headlamp as compared to the seeing-to-glare ratio that would be present in an otherwise identical headlamp having no vertical offset between the central longitudinal axis of the bulbous portion of the shroud and the optical axis of the discharge lamp.

20. A discharge lamp having an optical axis and comprising:

(a) an inner envelope comprising:

(a1) a hollow bulbous portion of vitreous light-transmitting material surrounding said optical axis and containing a fill including a metal-halide, (a2) first and second tubular portions of vitreous material joined to and extending along said optical axis in opposite directions from said bulbous portion, (a3) a disk-shaped enlargement on said first tubular portion projecting radially outward therefrom and integral therewith, (b) a pair of spaced-apart electrodes within said bulbous portion of the inner envelope between which an electric discharge is developed on said optical axis when the lamp is operated, (c) means for supporting said electrodes on said tubular portions, (d) a tubular shroud of vitreous material surrounding said inner envelope and comprising first and second hollow portions at opposite ends of the shroud and a light-transmitting enlarged bulbous portion located between said hollow portions, the first of said hollow shroud portions surrounding and substantially aligned with said disk-shaped enlargement and forming a first seal with the outer periphery of said disk-shaped enlargement, and in which:

(e) said shroud constitutes an outer wall and said disk-shaped enlargement constitutes an end wall of a chamber surrounding the tubular portions and the bulbous portion of said inner envelope, (f) the second of said hollow shroud portions has an outer periphery and an inner periphery surrounding said second tubular portion of the inner envelope, said inner periphery forming a second seal with the outer periphery of said second tubular portion, (g) the outer and inner dimensions of said second hollow shroud portion at said second seal are substantially smaller than the respective outer and inner dimensions of said first hollow shroud portion at said first seal, (h) said enlarged bulbous portion of the shroud surrounds the bulbous portion of said inner envelope and has an outer wall including a front zone surrounding said optical axis and located adjacent said first hollow shroud portion and a back zone surrounding said optical axis and located adjacent said second hollow shroud portion, and (i) said front zone has a configuration substantially conforming to a portion of the surface of a sphere having its center near said optical axis, and said back zone has a configuration substantially conforming to a portion of the surface of a ellipsoid having its center near said optical axis.

21. The discharge lamp of claim 20 in which:

(a) a reference point is located on said optical axis midway between said electrodes, and (b) the junction between said ellipsoidal back zone and said second hollow portion of the shroud is located a substantially larger distance from said reference point than is the junction between said spherical front zone and said first hollow portions of the shroud.

22. The discharge lamp of claim 20 in which the junction between said ellipsoidal back zone and said second hollow portion of the shroud is located a substantially smaller distance from said optical axis than is the junction between said spherical front zone and said first hollow shroud portion.

23. The discharge lamp of claim 20 in which the enlarged bulbous portion of the shroud has a central longitudinal axis that is offset by a small distance vertically upward from said optical axis.

24. The discharge lamp of claim 21 in which the enlarged bulbous portion of the shroud has a central longitudinal axis that is offset by a small distance vertically upward from said optical axis sufficient to substantially increase the seeing-to-glare ratio of a vehicle headlamp incorporating the discharge lamp compared to that of an otherwise identical headlamp in which the optical axis of the discharge lamp is located on the optical axis of the headlamp reflector.

25. The discharge lamp of claim 22 in which the enlarged bulbous portion of the shroud has a central longitudinal axis that is offset by a small distance vertically upward from said optical axis sufficient to substantially increase the seeing-to-glare ratio of a vehicle headlamp incorporating the discharge lamp compared to that of an otherwise identical headlamp in which the optical axis of the discharge lamp is located on the optical axis of the headlamp reflector.

26. A discharge lamp as defined in claim 17 in which said back tubular portion of the inner envelope includes a small-diameter enlargement thereon disposed within the inner periphery of said second hollow shroud portion, the second hollow shroud portion joining said second seal with the outer periphery of said small-diameter enlargement, and the diameter of said small-diameter enlargement being substantially smaller than the diameter of said disk-shaped enlargement.

27. In a vehicle headlamp comprising a reflector having an optical axis along which light is reflected from the reflector forwardly thereof, a lens at the front of the reflector for receiving and transmitting said reflected light, and a metal-halide discharge lamp having an optical axis disposed substantially parallel to the optical axis of the reflector and mounted in a position between said reflector and said lens for generating said reflected light, said discharge lamp comprising:

(a) an inner envelope comprising:

(a1) a hollow bulbous portion of vitreous light-transmitting material containing a fill including a metal-halide, (a2) two tubular portions of vitreous material joined to and extending in opposite directions from said bulbous portion, a front one of said tubular portions extending along the lamp optical axis from said bulbous portion toward said lens and a back one of said tubular portions extending along the lamp optical axis from said bulbous portion toward said reflector.

(b) a pair of spaced-apart electrodes within said bulbous portion of the inner envelope between which an electric discharge is developed substantially on the lamp optical axis when the lamp is operated, (c) means for supporting said electrodes on said tubular portions, (d) a tubular shroud of vitreous material surrounding said inner envelope and comprising first and second hollow portions at opposite ends of the shroud and a light-transmitting enlarged bulbous portion located between said hollow portions, the first of said hollow shroud portions surrounding said front tubular portion of the inner envelope, the second of said hollow shroud portions surrounding said back tubular portion of the inner envelope and the bulbous portion of the shroud surrounding the bulbous portion of the inner envelope and in which:

(e) said enlarged bulbous portion of the shroud has an outer wall including a front zone surrounding said lamp optical axis and located adjacent said first hollow portion and a back zone surrounding said lamp optical axis and located adjacent said second hollow shroud portion, (f) said front zone has a configuration substantially conforming to a portion of the surface of a sphere having its center near said lamp optical axis, and said back zone has a configuration substantially conforming to a portion of the surface of an ellipsoid having its center near said lamp optical axis, (g) said front zone is joined to said first hollow portion through a first junction and said back zone is joined to aid second hollow portion through a second junction, and (h) said second junction is located substantially closer to the lamp optical axis than said first junction.

28. The headlamp of claim 27 in which:

(a) a reference point is located on said lamp optical axis midway between said electrodes, and (b) said second junction is located a substantially larger distance from said reference point than is said first junction.

29. The headlamp of claim 27 in which said bulbous portion of the shroud has a central longitudinal axis that is offset by a small distance vertically upward from said optical axis of the discharge lamp sufficient to increase the seeing-to-glare ratio of the headlamp.

30. A headlamp as defined in claim 27 in which:

(a) a reference point is located on said lamp optical axis midway between said electrodes, (b) mounting structure for mounting said discharge lamp with respect to said reflector is provided within said reflector between said reflector and said discharge lamp, (c) a straight reference line can be constructed below said lamp optical axis from said reference point to said reflector that is disposed at a minimum included angle with respect to said lamp optical axis without intersecting said mounting structure, (d) a conical reference envelope is generatable by revolving said reference line about said lamp optical axis, and (e) said second junction is located within said conical reference envelope.

31. A headlamp as defined in claim 27 in which said back tubular portion of the inner envelope includes a small-diameter enlargement thereon disposed within the inner periphery of said second hollow portion and joined to said inner periphery, the diameter of said small-diameter enlargement being substantially smaller than the inner diameter of said first hollow portion of the shroud at said first junction.

32. A headlamp as defined in claim 27 and further comprising a glare-reducing shield positioned forwardly of said discharge lamp for blocking direct light from said discharge lamp from traveling forwardly of said discharge lamp directly through said lens in the region of said headlamp located above said lamp optical axis, said shield being substantially non-reflecting with respect to said blocked direct light.

33. A lamp having an optical axis and comprising:

(a) an inner envelope comprising a hollow bulbous portion of vitreous light-transmitting material surrounding said optical axis, (b) means for developing a source of light substantially on said optical axis when the lamp is operated, (c) a tubular shroud of vitreous material surrounding said inner envelope and comprising a light-transmitting bulbous portion surrounding said bulbous portion of the inner envelope, and in which:

(d) the bulbous portion of the shroud has an outer wall including a front zone surrounding said optical axis and located at the front of the bulbous portion of the shroud and a back zone surrounding said optical axis and located at the back of the bulbous portion of the shroud, and (e) said front zone has a configuration different from said back zone (f) said front zone has a configuration substantially conforming to a portion of the surface of a sphere having its center near said optical axis, and said back zone has a configuration substantially conforming to a portion of the surface of an ellipsoid having its center near said optical axis.

34. A lamp as defined in claim 33 and further comprising a pair of electrodes having tips within said hollow bulbous portion of the inner envelope between which an arc is developed on said optical axis when the lamp is operated.

* * * * *